US006400749B1

(12) United States Patent
Weiss

(10) Patent No.: US 6,400,749 B1
(45) Date of Patent: Jun. 4, 2002

(54) INDUCTION HEATING

(75) Inventor: Stephen Stewart Weiss, London (GB)

(73) Assignee: Elmelin PLC, London (GB)

( * ) Notice: Subject to any disclaimer, the term of this patent is extended or adjusted under 35 U.S.C. 154(b) by 0 days.

(21) Appl. No.: 09/647,017

(22) PCT Filed: Mar. 25, 1999

(86) PCT No.: PCT/GB99/00937

§ 371 (c)(1),
(2), (4) Date: Sep. 26, 2000

(87) PCT Pub. No.: WO99/49701

PCT Pub. Date: Sep. 30, 1999

(30) Foreign Application Priority Data

Mar. 26, 1998 (GB) ..... 9806619

(51) Int. Cl.[7] ..... H05B 6/22
(52) U.S. Cl. ..... 373/156; 373/154
(58) Field of Search ..... 373/4, 59, 138, 373/140, 145, 146, 151, 152, 155, 156, 159, 163, 164

(56) References Cited

U.S. PATENT DOCUMENTS

| | | | | | |
|---|---|---|---|---|---|
| 3,708,600 | A | * | 1/1973 | Nickel et al. | 373/138 |
| 4,675,879 | A | * | 6/1987 | Meredith | 373/155 |
| 5,280,495 | A | | 1/1994 | Havas et al. | |
| 5,416,795 | A | * | 5/1995 | Kaniuk et al. | 373/155 |
| 5,781,581 | A | * | 7/1998 | Fishman et al. | 373/152 |
| 6,148,018 | A | * | 11/2000 | Garcia et al. | 373/145 |

FOREIGN PATENT DOCUMENTS

| | | |
|---|---|---|
| CH | 408293 | 12/1966 |
| EP | 160384 | 11/1985 |
| EP | 801516 | 10/1997 |
| FR | 2101903 | 3/1972 |
| WO | WO 97/18690 | 5/1997 |

* cited by examiner

*Primary Examiner*—Tu Ba Hoang
(74) *Attorney, Agent, or Firm*—Caesar, Rivise, Bernstein, Cohen & Pokotilow, Ltd.

(57) ABSTRACT

An induction furnace includes material between the crucible and the coil to enable easy removal when the crucible needs to be replaced. The material is made up of a slip plane material and reinforcement, and preferably comprises a laminate of flexible mica paper and glass fabric.

14 Claims, 1 Drawing Sheet

INDUCTION HEATING

BACKGROUND OF THE INVENTION

1. Field of the Invention

The invention relates to induction heating, and in particular to a coreless induction furnace or induction heated channel furnace and a lining material therefor.

2. Description of the Prior Art

A coreless induction furnace usually comprises a vessel having a refractory crucible inside a water cooled induction coil. The innerface of the induction coil is usually covered by a thin layer of refractory plaster which is called the coil grout. There is a need to interpose a layer between the coil grout and the refractory crucible to provide a slip plane between these two surfaces. FR-A-2101903 discloses an induction furnace having a slip plane comprising a layer of spun glass fiber.

BRIEF SUMMARY OF THE INVENTION

According to the invention in one aspect there is provided an induction furnace comprising a vessel comprising a refractory crucible within a cooled induction coil, slip plane material and supporting material being present between the crucible and the coil, characterized in that the slip plane material comprises a flexible mica paper or sheet.

In a much preferred feature the slip plane material and the supporting material are present as a laminate.

Preferably the supporting material therefor is a glass fiber fabric. Preferably the glass fabric has a density of between about 500 g/m$^2$ and about 1500 g/m$^2$, preferably 800 to 1350 g/m$^2$ and a thickness of between 0.8 to about 2.5 mm. preferably 1.4 mm. to 2.2 mm. Preferably the glass fiber fabric is woven.

In another aspect the invention provides a method of preparing a coreless induction furnace comprising a vessel having a refractory crucible surrounded by a cooled induction coil, the method comprising locating a slip plane material L1 and other material (L2) in between, characterized by interposing a layer of flexible mica or sheet as the slip plane material (L1) between the refractory crucible wall (2) and the surrounding cooled inducting coil.

In yet another aspect the invention provides for use in the lining of an induction furnace as defined, a laminate comprising a layer of flexible mica paper or sheet and supporting layer of glass fiber fabric. The two layers being held together by an inorganic binder.

Figure 1:
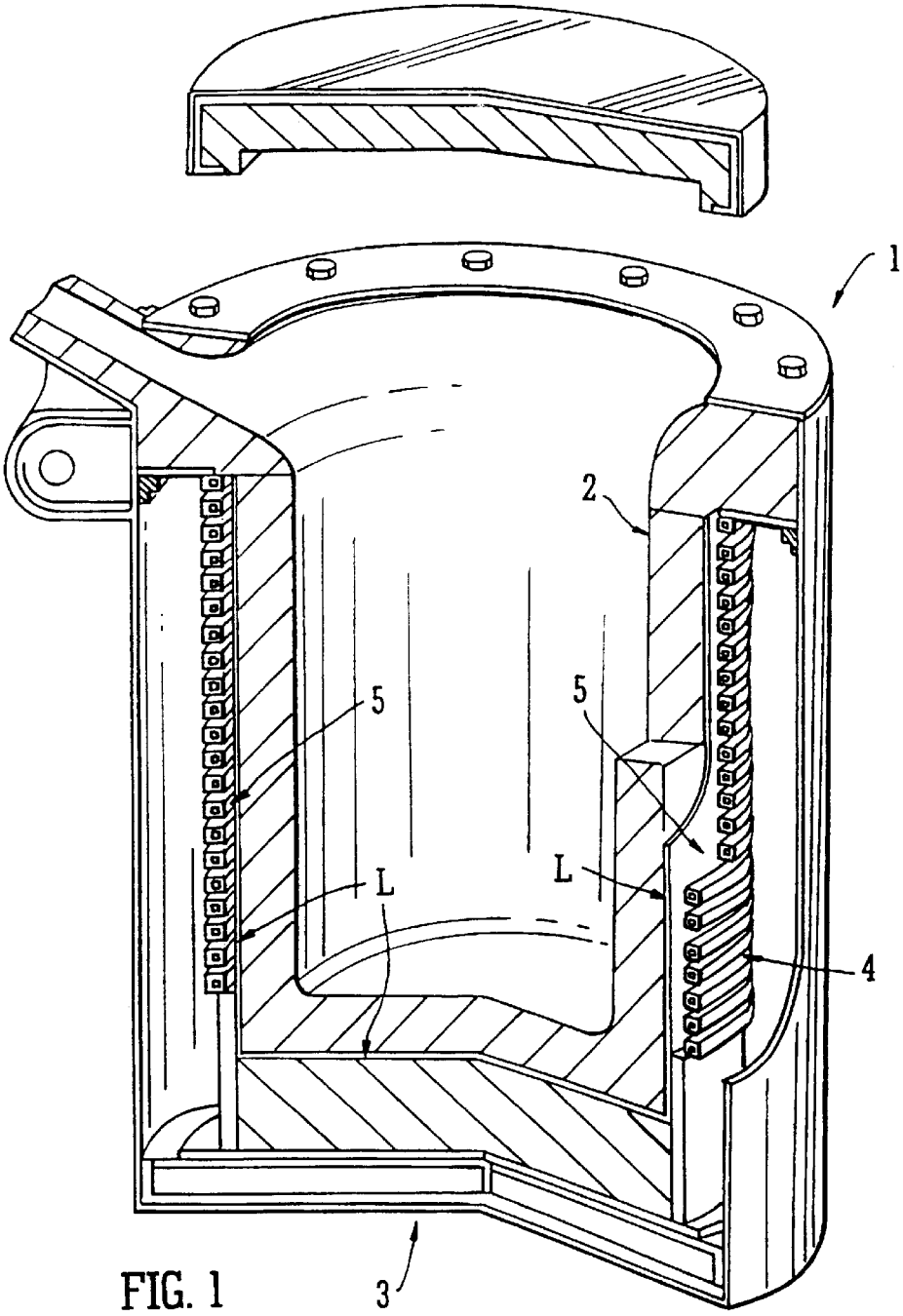
Figure 2:
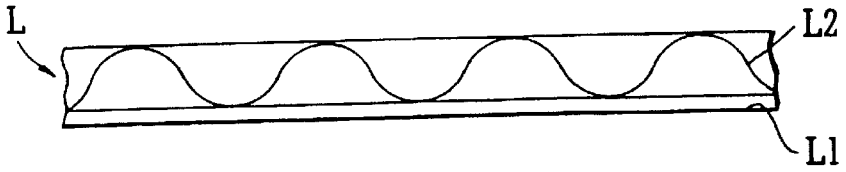

In order that the invention may be well understood it will now be described by way of illustration only with reference to the accompanying diagrammatic drawings, in which: The furnace comprises a crucible having a cast refractory side wall 2 and floor 3. A water cooled induction coil 4 surrounds the side wall 2. The coil is held to a metal frame, not shown, which is plastered by a layer of grout 5 to provide a smooth surface facing the crucible. The grout is about 8 to 10 mm thick. Between the grout 5 and the side wall 2 is a laminate L of the invention. As shown in FIG. 2 the laminate comprises a high temperature flexible mica paper L1 and a heavyweight woven glass fabric L2. The laminate is arranged so that the mica layer faces the coil grout. The mica paper is about 0.2 mm to about 0.35 mm thick and the glass fabric is about 0.8 to about 2.5 mm thick and has a density of about 500 to about 1500 gsm. The two layers are held together by a high temperature inorganic binder applied to the facing surfaces of the mica and the glass fiber fabric, and then urged under pressure on to the woven glass fabric. Mica, not shown, is usually applied to the floor 3.

In assembly the furnace laminate is fitted between the crucible wall and the coil grout and the floor. The laminate is provided as roll and cut to size and shape on site. The presence of the binder and the mica facing ensure that when cut any slithers of glass do not escape into the air and cause skin irritation to operatives. The presence of the laminate provides a good slip plane between the crucible and the coil grout. This allows a) the crucible to expand and contract during operation without either damaging the induction coil or allowing cracks to form in the crucible. b) The crucible to be broken out or pushed out much more easily when it is being replaced at the end of its useful life. Glass fiber fabric when used on its own often sticks to the coil grout. It can then only be removed by mechanical means thus generating a great deal of airborne glass fibers. The presence of the mica alongside the glass fabric produces a laminate with significantly improved heat transference characteristics than glass fiber fabric on its own. This has important technical advantages as it helps heat to be transferred away from the hot face of the crucible, towards the water cooled coil. This slows down the vitrification of the crucible and consequently enhances its service life.

The invention is not limited to the embodiment shown. Mica may be present on both sides of the glass fiber fabric. The glass fiber fabric may be non-woven.

What is claimed is:

1. An induction furnace comprising a vessel contains a refractory crucible surrounded by a cooled induction coil, wherein slip plane material and supporting material therefor are present between the crucible and the coil and the slip plane material comprises a flexible mica paper or sheet.

2. A furnace according to claim 1, wherein the slip plane material and a supporting material therefor are present as a laminate.

3. A furnace according to claim 1, wherein the slip plane material is held to the supporting material by an inorganic binder.

4. A furnace according to claim 1, wherein the supporting material is a glass fiber fabric.

5. A furnace according to claim 1, wherein the glass fiber fabric has a density of between 500 g/m$^2$ and 1500 g/m$^2$.

6. A furnace according to claim 1, wherein the glass fiber fabric has a thickness of between 0.8 mm and 2.5 mm.

7. A furnace according to claim 1, wherein the glass fiber fabric is woven.

8. A method of preparing a coreless induction furnace for use, the furnace comprising a vessel containing a refractory crucible surrounded by a cooled induction coil, the method comprising interposing a slip plane material in the form of a layer of flexible mica or sheet and a supporting material therefor between the refractory crucible wall and the surrounding cooled induction coil.

9. A method according to claim 8, comprising interposing a laminate comprising a layer of flexible mica paper or sheet and a supporting layer of glass fiber fabric between the refractory crucible wall and the surrounding cooled induction coil.

10. A laminate for use in the lining of an induction furnace by a method according to claim 8, tie laminate comprising a layer of flexible mica paper or sheet and a supporting layer of glass fiber fabric, the two layers being held together by an inorganic binder.

11. A laminate according to claim 10, wherein the mica layer is between 0.2 mm and 0.35 mm thick.

12. A laminate according to claim 10, wherein the glass fiber fabric has density of between 500 $g/m^2$ and 1500 $g/m^2$.

13. A laminate according to claim 10, wherein the glass fiber fabric has a thickness of between 0.8 mm and 2.5 mm.

14. A laminate according to claim 10, wherein the glass fiber fabric is woven.

* * * * *